US005479760A

United States Patent [19]

Petrell

[11] Patent Number: 5,479,760

[45] Date of Patent: Jan. 2, 1996

[54] CLAMSHELL PACKAGING MACHINE AND METHOD

[76] Inventor: Howard C. Petrell, 23025 Mobile St., West Hills, Calif. 91307

[21] Appl. No.: 163,050

[22] Filed: Dec. 6, 1993

[51] Int. Cl.[6] ..... B65B 35/30; B65B 61/20

[52] U.S. Cl. ..... 53/445; 53/474; 53/158; 53/155; 53/238; 53/381.6

[58] Field of Search ..... 29/773, 775; 53/410, 53/445, 460, 474, 238, 284.3, 284.4, 381.6, 155, 170, 569, 158

[56] References Cited

U.S. PATENT DOCUMENTS 4,523,422 6/1985 Isemann ..... 53/238 X
4,586,318 5/1986 Litt et al. ..... 53/469 X
4,922,689 5/1990 Haas et al. ..... 53/569
5,163,271 11/1992 Pan et al. ..... 53/155 X
5,285,620 2/1994 Kaye et al. ..... 53/238 X

*Primary Examiner*—Linda Johnson
*Attorney, Agent, or Firm*—Merchant, Gould, Smith, Edell, Welter & Schmidt

[57] ABSTRACT

A wrap suspended in air by creating a cushion of air above and below the wrap is inserted into an envelope, formed by a clear plastic cover and the body of a clamshell, by propelling the wrap and the cushion of air into the envelope. The clear plastic cover is initially moved away from the body of the clamshell to enlarge the envelope opening so the wrap can be inserted. Video cassettes or other articles may be located within the clamshell by a conveyor system substantially contemporaneously with the insertion of the wrap.

8 Claims, 7 Drawing Sheets

CLAMSHELL PACKAGING MACHINE AND METHOD

FIELD OF THE INVENTION

The present invention generally relates to packaging equipment, more specifically to a system for automatically inserting a wrap into a clamshell. The present invention also relates to associated packaging such as video cassette packaging.

BACKGROUND OF THE INVENTION

A variety of goods, including video cassettes are packaged in plastic enclosures referred to as clamshells. A typical clamshell package is formed of a semi-rigid plastic material and includes an interior molded cavity to accommodate the particular goods to be inserted. A typical clamshell for a video cassette is rectangularly shaped and has a cavity slightly larger than the video cassette for holding the video cassette. The outside body of the clamshell typically has a clear plastic cover attached on two or three sides to the clamshell. The unattached side is open, allowing a cover sheet, referred to as a wrap, to be inserted between the clamshell body and the clear plastic cover.

Once the goods are placed within the clamshell and the wrap is inserted between the clear plastic and the clamshell, the clamshell assembly is folded so that the goods are enclosed within the cavity of the clamshell. The clamshell is hinged at one side and can be repeatedly opened and closed to access or store the goods contained within the clamshell cavity. Thus, the clamshell is a convenient packaging for the sale of numerous products, including video and audio cassette tapes and personal computer software. The wrap is visible to purchasers through the clear plastic cover to entice them to buy the goods in a retail outlet. Also, the clamshell is durable, providing convenient long term storage of the goods.

Inserting the wrap between the clear plastic cover and the clamshell and then placing the goods into the clamshell cavity is usually a time consuming manual operation. The wrap must be properly inserted into an envelope defined by the semi-rigid body of the clamshell and the clear plastic cover of the clamshell. Insertion of the wrap is typically performed by manual labor. Usually, manual insertion involves first inverting the clamshell, second moving the clear plastic on the outside of the clamshell away from the body of the clamshell and then manually inserting the wrap between the clear plastic cover and the body of the clamshell. The amount that each clamshell is inverted depends on the particular operator inserting wraps into the clamshell.

Once the wrap is in place, a video cassette is placed within the clamshell cavity. Advertising brochures or flyers are usually placed on top of the video cassette inside the clamshell cavity. The advertising may be for future video cassettes or discounts on the purchase of additional video cassettes. The clamshell is then closed to retain the video cassette and advertising, and to display the wrap through the clear plastic cover on the outside of the clamshell.

The above mentioned process is extremely time consuming, and difficult to perform manually. Further, it is estimated that a large number of wraps are placed upside down, and/or are damaged or destroyed during insertion into the clamshell. Also, the manual mistakes may cause advertisements or wraps to be misplaced or mispackaged resulting in undesirable variation between ideally identical packages.

The process is similar for inserting a wrap into a package for computer product sales, or other product whose characteristics make it appropriate to package the product in a clamshell, although the rest of the packaging process may vary depending on the nature of the product. Heretofore there has been no automatic machines for such insertion.

SUMMARY OF THE INVENTION

The present invention provides an automatic insertion system to place a wrap into an envelope formed by the body of a clamshell and a clear plastic cover of the clamshell automatically. The wrap is inserted in the desired location without damaging the wrap. Wraps that are not inserted are not destroyed, but are rejected for hand completion. The present invention also automatically inserts goods, such as video cassette tapes, into the clamshell cavity. Further, advertising or other inserts can be placed on top of the goods, such as a video cassette, within the clamshell cavity.

The present invention is a complete automated system which allows a clamshell to be prepared for shipping with minimal manual intervention. Variation between packages, which is inherent and inevitable with manual assembly, is eliminated and uniform packing is accomplished by the automated aspects in the present invention. Moreover, the present invention reduces the time required to insert a wrap and goods into a clamshell and prepare the clamshell for shipping. Also, the present invention provides a repeatable and reliable way to separate the clear plastic cover from the clamshell by a predetermined amount. In addition, waste caused by damaged or destroyed wraps is greatly reduced with the automated aspects of the present invention.

Further, the wrap can be inserted without inverting the clamshell. This is accomplished by suspending the wrap in air. The air flow suspending the wrap flows in a predetermined configuration to transfer the wrap from a first location to a second desired location. By suspending the wrap in air, the wrap can be moved at high speeds and with minimal risk of damaging or destroying the wrap.

One embodiment of the present invention employs an array of suction cups to separate the clear plastic cover from the clamshell body to widen the opening of the envelope. The wrap is then suspended in air and propelled into the opening of the envelope. Next, video cassette tapes are oriented and placed into the clamshell cavity, and advertising literature is deposited on top of the video cassette tapes. The clamshell is then closed, completing the operation.

The foregoing and still further features and advantages of the present invention as well as a more complete understanding thereof will be made apparent from a study of the following detailed description of the invention in connection with the accompanying drawing and appended claims.

DETAILED DESCRIPTION OF A PREFERRED EMBODIMENT

Figure 1:
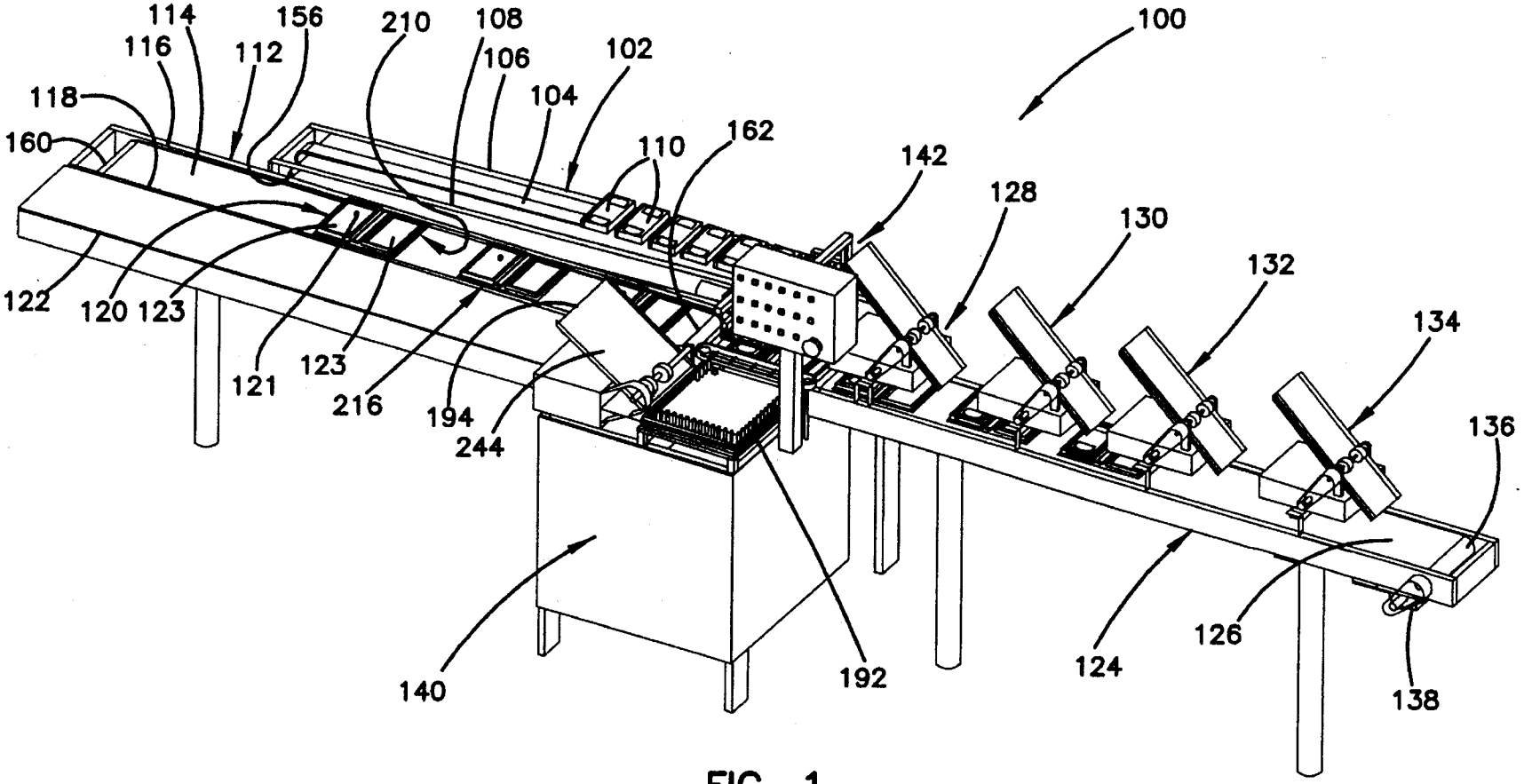
FIG. 1 shows a perspective view of a system for loading wraps and video cassettes into a clamshell.
Figure 2:
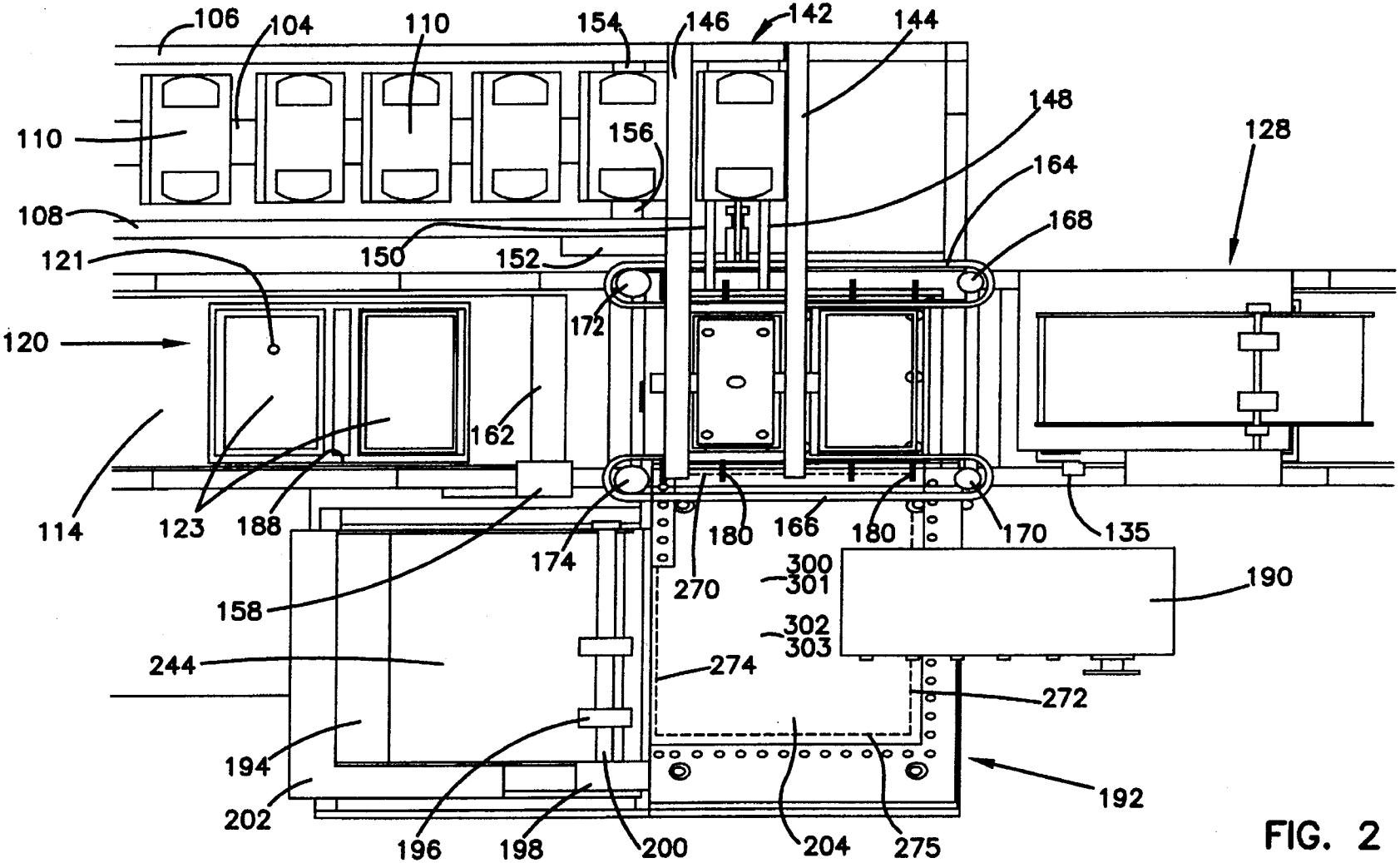
FIG. 2 shows a top view of the embodiment of FIG. 1.

Referring to FIGS. 1–2, a system is illustrated for automatically loading a video cassette 110 into a clamshell cavity 123, inserting a wrap 244 into an envelope 216 formed by the outside body of clamshell 120 and a clear plastic cover 210, and placing advertising literature on top of the video cassette 110. The system can be readily adapted to insert wrap 244 into envelope 216 of clamshell 120 for other product packaging, such as computer software or other appropriate products.

packaging machine 100 transports video cassettes 110 and clamshells 120 to an insertion machine 140. The video cassettes 110 are placed in clamshell cavity 123 of clamshell 120 and wrap 244 is inserted into the envelope 216 of clamshell 120 (see also FIGS. 3 and 5). After video cassette 110 and wrap 244 are inserted into clamshell 120, advertising literature is inserted by one or more of the series of paper handlers 128, 130, 132, and 134.

A conveyor assembly 102 guides video cassettes 110 towards the insertion machine 140. Conveyor assembly 102 includes a continuous loop conveyor belt 104 and a pair of side rails 106 and 108. Video cassettes 110 are placed on conveyor belt 104 between side rails 106 and 108 and are uniformly oriented. It is recognized that a variety of sorting equipment can be used to properly locate and orient video cassettes 110 within video cassette feeder assembly 102.

Video cassettes 110 are oriented such that the sprockets, which are engaged to move the video tape within the video cassette 110, are located on the bottom of the video cassette 110, adjacent to conveyor belt 104. A flip up door that protects the video tape in video cassette 110 during transportation is oriented facing away from insertion machine 140.

Drive belts 148 and 150 transfer video cassettes 110 towards clamshell 120 when a drive assembly 142 is activated. Drive belts 148 and 150 are preferably high friction belts. A pair of rails 144 and 146 guide video cassettes 110 to remain properly oriented so that clamshell 120 can receive video cassettes 110. Video cassettes 110 fed along conveyor belt 104 are stopped when they are positioned over drive belts 148 and 150.

In one embodiment, drive belts 148 and 150 move sufficiently fast to generate momentum in video cassette 110 to carry the video cassette past belt 164, allowing video cassette 110 to drop into clamshell cavity 123 of clamshell 120. In an alternative embodiment, belts 148 and 150 extend above belt 164 and move at a slower speed, and extend to the edge of the clamshell cavity 123 of clamshell 120, allowing video cassette 110 to drop down a small distance into clamshell 120 and be properly positioned.

In yet another embodiment, drive belts 148 and 150 are supplemented or replaced by a vacuum driven or mechanically driven lifting system. Video cassettes 110 are positioned immediately above the desired location within clamshell cavity 123 of clamshell 120.

Movement of video cassette 110 can be accomplished simultaneously with the operation of wrap inserter 192. It is preferred that wrap 244 be positioned within envelope 216 before video cassette 110 is inserted into clamshell cavity 123 of clamshell 120. This minimizes or eliminates the alteration of the position of clamshell 120 during the insertion of video cassette 110 into clamshell cavity 123. Referring to FIG. 2, when video cassettes 110 are placed in clamshell cavity 123 of clamshell 120, it is preferred to insert the video cassettes 110 when clamshell 120 is precisely positioned and stopped. This occurs during the insertion of wrap 244 into envelope 216 of clamshell 120.

Clamshells 120 are placed on continuous belt conveyor 114 and between a pair of tracks 116 and 118. Clamshell 120 is shown having a single circular protrusion 121 located in clamshell cavity 123 of clamshell 120. This protrusion 121 is designed to engage with the drive sprocket of the video cassette 110. Video cassette 110 is prevented from being placed in the clamshell cavity 123 of the clamshell 120 upside down. Because the location of the drive sprockets on the video cassette 110 are symmetrical, the orientation of video cassette 110 within clamshell cavity 123 of clamshell 120 is not critical.

When clamshells 120 are placed on conveyor 114, it is important that the opening forming the envelope 216 between the outside body of clamshell 120 and clear plastic cover 210 be oriented to face toward track 118. This is important because wrap 244 to be inserted into envelope 216 will be inserted from wrap insert mechanism 192 which is facing clamshell 120 and adjacent to track 118.

Conveyor belt 104 rotates around a pair of rollers 154 and 156. Roller 154 is driven by drive motor 152, as shown in FIG. 2. Similarly, conveyor belt 114 rotates around a pair of rollers 160 and 162. A drive motor 158 drives roller 162. Conveyor belt 126 rotates about rollers 135 and 136 and is driven by a drive motor 138. Drive motors 152 and 158 can be set up to run continuously, causing video cassettes 110 and clamshells 120 to move towards packaging insertion machine 140. Alternatively, drive motors 152 and 158 can be controlled by sensors to activate the motors to move video cassettes 110 and clamshells 120 into a pre-determined position.

In systems where drive motors 152 and 158 run continuously, conveyor belts 104 and 114 should be made of a low friction material to avoid damage to video cassettes 110 and clamshells 120. A sensor, such as an electric eye or microswitch can be located at the end of conveyor belts 104 and 114. The sensors detect the presence of video cassette 110 and clamshell 120, respectively. When no video cassette 110 or clamshell 120 is present at the desired location, drive motor 152 or 158 is selectively activated. When the video cassette 110 or clamshell 120 is located in the desired position, movement of the respective conveyor belt is halted.

The drive motor 138 drives the conveyor belt 126 moving clamshell 120 away from insertion machine 140. The drive motor 138 is usually activated incessantly, causing conveyor belt 126 to run continuously. Continuous movement is preferred for conveyor belt 126 so that the completed clamshell assemblies can be moved away from insertion machine 140. Advertising inserters 128, 130, 132, and 134 are located above conveyor 126 and may be pitney Bowes model 3144 inserters, or the like. The advertising inserters 128, 130, 132 and 134 place advertising, discount flyers, or surveys on the top of video cassette 110 within clamshell 120. A sensor may be used to trigger advertising inserters 128, 130, 132 and 134, or advertising inserters 128, 130, 132 and 134 may be synchronized with the operation of insertion machine 140.

Clamshells 120 are moved into insertion machine 140 from conveyor 114. Clamshells 120 are positioned adjacent to wrap inserter 192 and video cassette inserter 142. As shown in FIG. 2, wrap 244 is fed into inserter 192. Wraps 244 are placed on a surface 194 of a table 202. A set of suction arms or friction feed assemblies 196 may be located on a movable or rotatable rod 200 and driven by a motor 198.

A variety of commercial feeding assemblies are available which can be set up to insert wrap 244 into wrap inserter 192. As the wrap 244 is being inserted into wrap inserter 192, injection jets 300, 301, 302 and 303 are activated. Air flows from these injection jets 300, 301, 302, and 303 forcing wrap 244 into the desired position within the wrap inserter 192.

Figure 3:
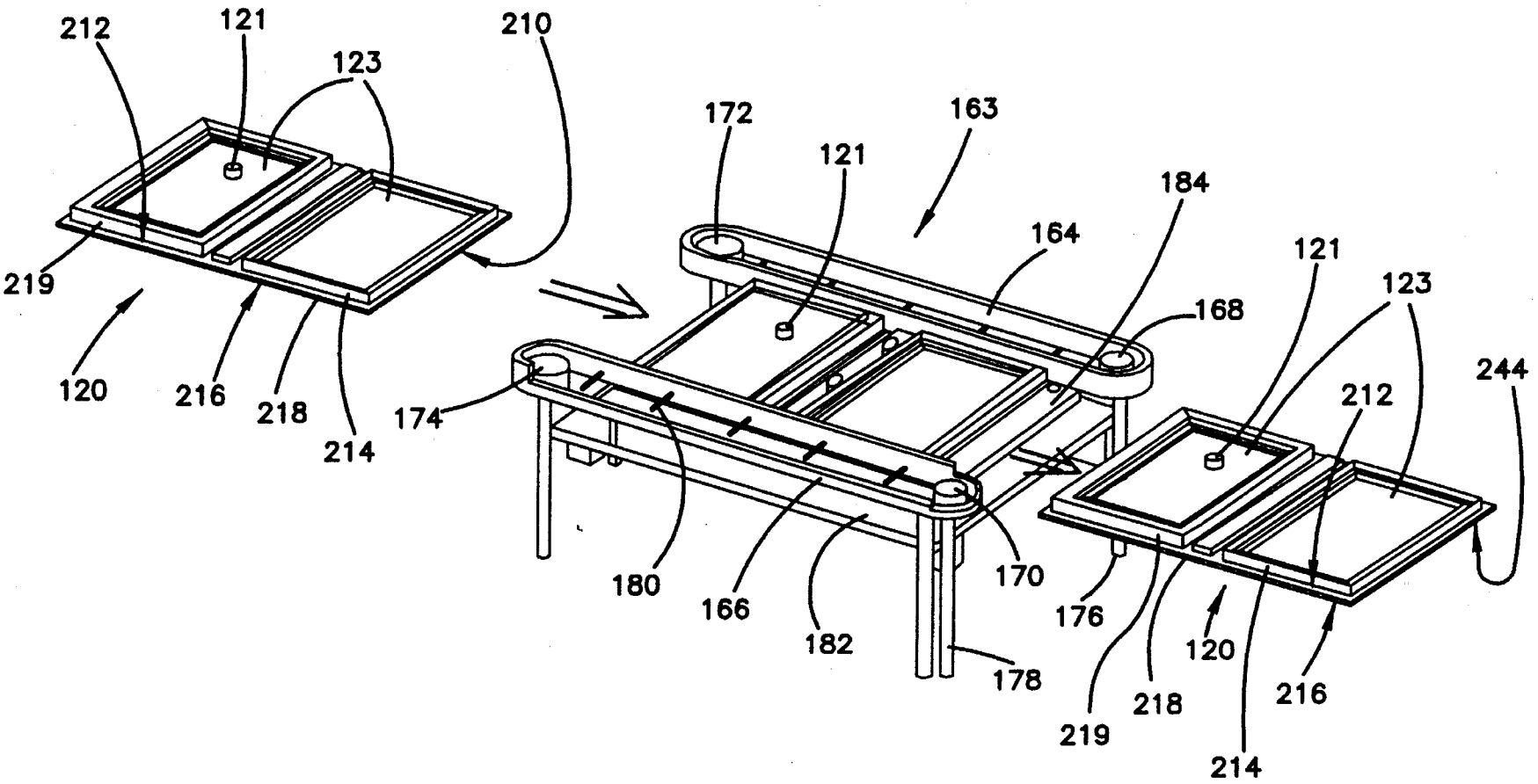
FIG. 3 is an exploded perspective view of the interaction between the clamshell and the clamshell dock.
Figure 5:
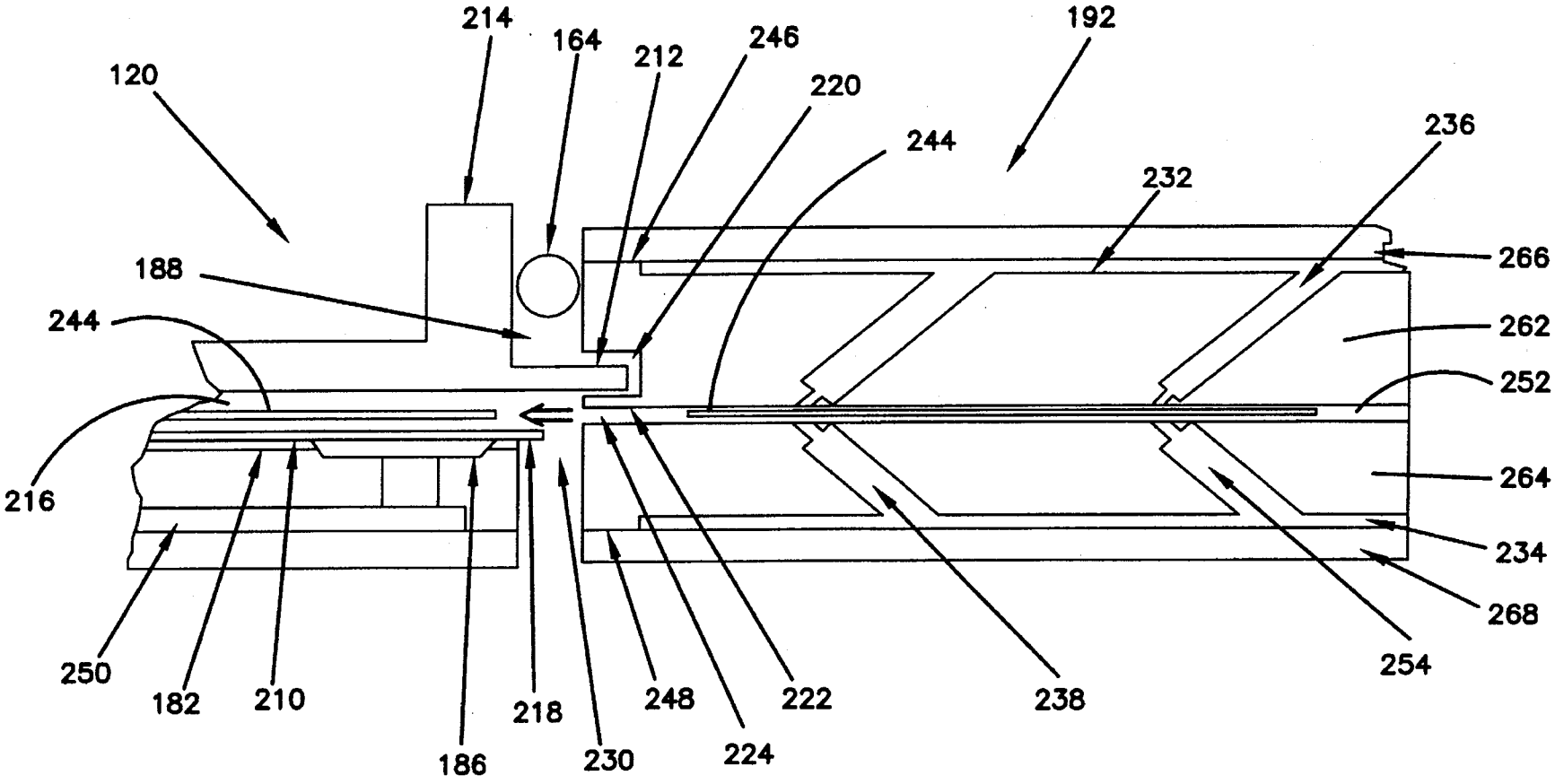
FIG. 5 is an exploded side view of one portion of the apparatus showing the interaction between the clamshell and a section of the wrap inserter.

Referring to FIGS. 3 and 5, clamshell 120 is typically formed by a plastic case, referred to as the clamshell body, and has clamshell cavity 123 whose overall depth is slightly greater than the thickness of the item or goods to be placed in clamshell cavity 123, such as a video cassette 110 of FIG. 2. In the configuration shown, video cassette 110 of FIG. 2 fits snugly into clamshell cavity 123, and does not require significant force to insert or remove video cassette 110 from clamshell cavity 123. On the outside of clamshell 120 is a clear plastic cover 210 permanently attached on two or three sides to the outside body of clamshell 120 creating at least one opening and forming the envelope 216.

The wrap 244 is typically illustrated with the title and a promotional layout of the contents of video cassette 110 of FIG. 2 to be contained within the clamshell cavity 123 of clamshell 11. Wrap 244 is inserted into envelope 216 between the outside body of clamshell 120 and the clear plastic cover 210 so that the promotional illustration is visible through clear plastic cover 210. An open edge 218 of clear plastic cover 210 is typically located on the outside body of clamshell 120 and along the length of clamshell 120. Clamshells 120 are oriented such that open edge 218 of clamshell 120 is facing wrap inserter 192.

Figure 4:
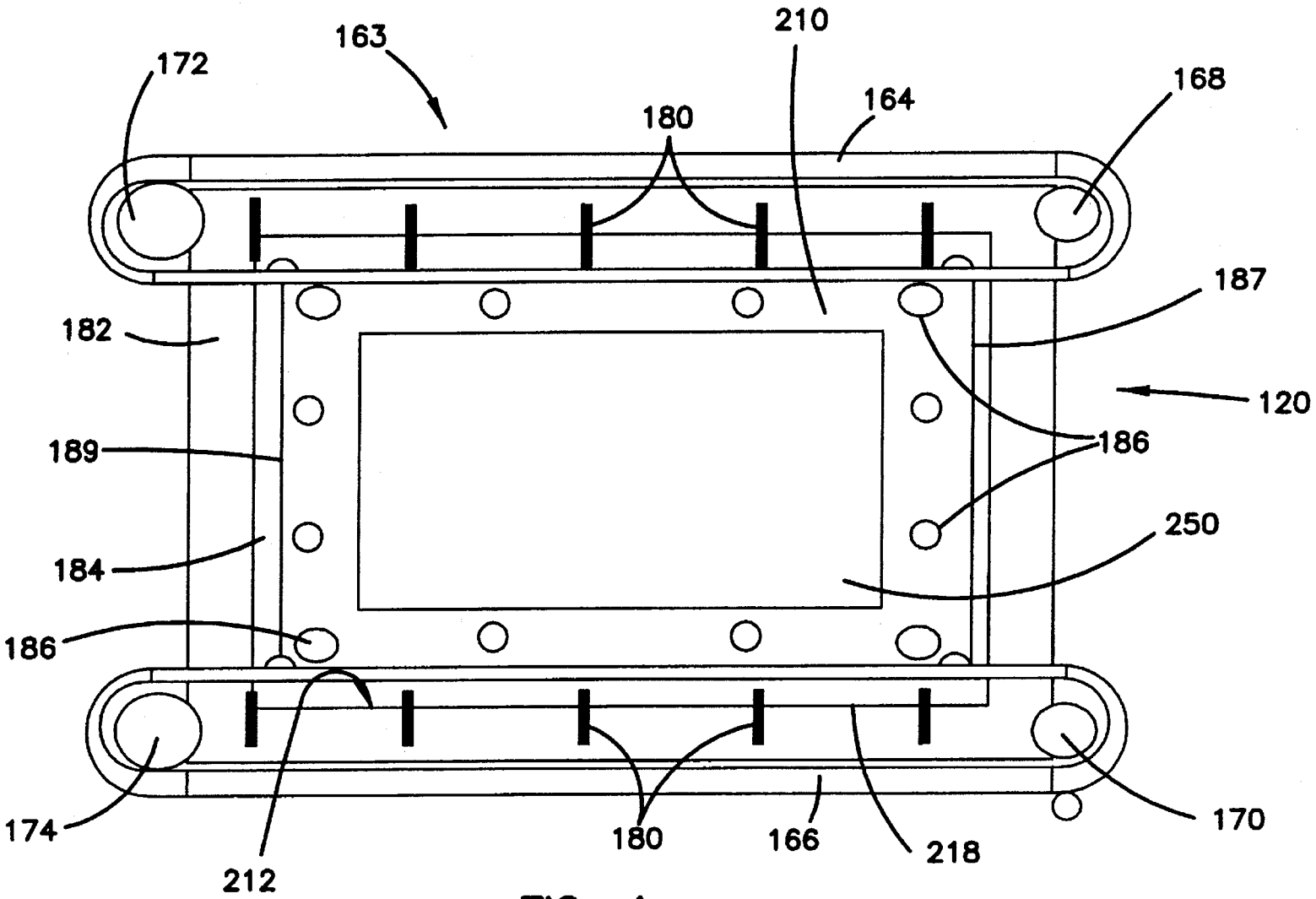
FIG. 4 is a bottom view of the clamshell dock.

Referring to FIGS. 3 and 4, clamshells 120 are moved into the desired position on a clamshell dock 163 by a pair of clamshell drive belts 164 and 166 of clamshell dock 163. Clamshell drive belt 164 is a continuous belt that rotates about a pair of rollers 168 and 172. Similarly, the clamshell drive belt 166 is a continuous loop drive belt which rotates about a pair of rollers 170 and 174. A series of springs 180 cause clamshell drive belts 164 and 166 into pressing engagement with clamshell 120. Springs 180 may be coil springs or leaf springs secured at one or both ends. Clamshell drive belts 164 and 166 move clamshell 120 into a predetermined position on a table 182.

The position of clamshell 120 on table 182 is arranged so that a series of vacuum driven suction cups 186 are located around the periphery of clear plastic cover 210. A solid plate 250 is located within the periphery defined by suction cups 186. Suction cups 186 are preferably positioned adjacent to clear plastic cover 210, and are within 0.050 to 0.100 of an inch of clear plastic cover 210, plate 250 is within all suction cups 186. A one-eighth wide edge at a height 0.031 below the top of suction cup 186 provides support on two sides of edge 212 of the clamshell 120.

In one embodiment, suction cups 186 can be raised until they come into contact with clear plastic cover 210 of clamshell 120, to lower clear plastic cover 210 away from the body of clamshell 120, enlarging envelope 216. The distance that suction cups 186 can be raised or lowered is approximately one-eighth of an inch. In an alternative embodiment, suction cups 186 are stationary and are employed to hold clear plastic cover 210 stable as wrap 244 is inserted in envelope 216.

Plate 250 is preferably located approximately 0.030–0.050 inches below the surface of suction cups 186. Plate 250 prevents clear plastic cover 210 from sagging or becoming distended. If clear plastic cover 210 were to sag excessively in the center there is a risk that the suction between suction cups 186 and clear plastic cover 210 may be lost, causing clear plastic 210 cover to interfere with the insertion of wrap 244. Suction cups 186 are approximately ½ inch diameter rubber cups in one embodiment.

When a vacuum is applied to suction cups 186, they will draw clear plastic cover 210 away from the body of clamshell 120 causing the envelope 216 to enlarge. It is important that all suction cups 186 located around the periphery of clear plastic cover 210 be positioned at the same distance away respectively from the body of clamshell 120 to ensure a uniform enlarging of the envelope 216 of clamshell 120. Enlarging the envelope 216 uniformly for each clamshell 120 that goes through inserter 140 is important in order to ensure consistency of the insertion machine 140.

By using suction cups 186 to draw clear plastic cover 210 away from the body of the clamshell 120, it becomes unnecessary (and undesirable) to invert clamshell 120 in order to insert wrap 244 into envelope 216 of clamshell 120.

It is preferred that wrap 244 be positioned within envelope 216 before video cassettes 110 come into contact with clamshell 120. This eliminates or minimizes the possibility of release of contact of the suction cups 186 with the clear plastic cover 210.

Referring to FIG. 5, clamshell 120 is oriented so that edge 212 of clamshell 120 is positioned within a channel 220 defined by a tab 222 and upper plate 262 of the wrap insert mechanism 192. Tab 222 is located along the lower portion of upper plate 262. A lower plate 264 is located immediately below upper plate 262. A chamber 252 is formed by lower plate 264 and upper plate 262. Tab 222 holds edge 212 above an opening 224 located between upper plate 262 and lower plate 264. Wrap 244 is fed into inserter 192 by raising upper plate 262 about 0.125 inches and activating a sheet feeder of inserter 192. Wrap 244 is then expelled from opening 224 into envelope 216 of clamshell 120.

Reservoirs 232 and 234 are formed by milling away an area approximately 0.125 inches thick out of upper plate 262 and lower plate 264, respectively. A pair of cover plates 266 and 268 are sealed against upper plate 262 and lower plate 264 by a pair of O-rings 246 and 248, respectively. Cover plates 266 and 268 are approximately one quarter inch thick aluminum plates, such as Alcoa QQ-A-250/12. Upper plate 262 and lower plate 264 are also preferably aluminum, although other materials, such as steel or plastic, can be used.

Reservoirs 232 and 234 can be pressurized after wrap 244 is positioned and upper plate 262 lowered, causing air to flow uniformly through the openings in upper plate 262 and lower plate 264. This causes wrap 244 to be expelled out of opening 224 and into envelope 216 of clamshell 120. A sensor may be positioned near tab 222 to detect the passage of wrap 244 out of chamber 252. Alternatively, air flow into reservoirs 232 and 234 may continue for a predetermined period of time sufficient to ensure wrap 244 is expelled from chamber 252.

Once wrap 244 has been positioned within envelope 216, suction is released from suction cups 186 and clamshell 120 can be moved from clamshell dock 163 and away from inserter 192. During this time, the next wrap 244 can be loaded into wrap inserter 192.

Figure 6:
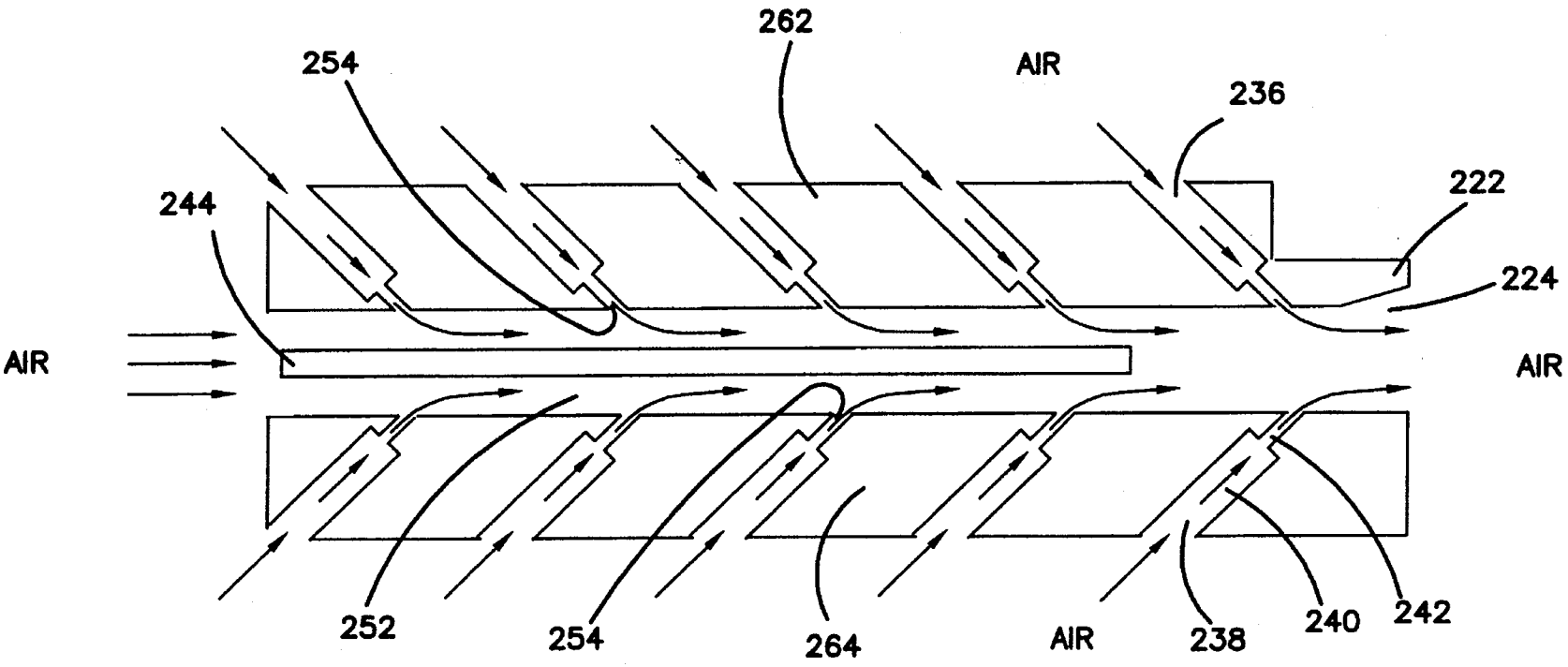
FIG. 6 is an exploded side view of a section of the wrap inserter.

Referring to FIGS. 5–6, wrap 244 is suspended in air before and during insertion into envelope 216. Air surrounds both the upper and lower surfaces of wrap 244. A number of angled openings 254 provide a source of air flow within chamber 252. preferably, openings 254 are located at the end of holes 236 and 238 located above and below chamber 252, respectively. Holes 236 and 238 create a channel through which air can flow.

preferably, holes 236 and 238 are formed at two-dimensionally compounded 30 degree angles toward opening 224, with respect to chamber 252. Wrap 244 is placed within chamber 252 and is suspended by air flowing through holes 236 and 238 into chamber 252. In addition to creating air flow away from the top and bottom of chamber 252, the air flow will be directed toward opening 224 and will tend to force wrap 244 out of chamber 252 through opening 224.

Since envelope 216 of clamshell 120 is located adjacent to, and facing opening 224, the flow of air out of opening 224 will tend to flow into envelope 216. Thus, the air flow coming out of opening 224 will tend to enlarge envelope 216 and will tend to force the edge 218 of clear plastic cover 210 downward, away from the body of clamshell 120, creating a wider entrance of envelope 216. If sufficient air flow is present, wrap 244 will be propelled out of chamber 252 into envelope 216. The cushion of air above and below wrap 244 will tend to force wrap 244 as far into envelope 216 as possible.

preferably, holes 236 and 238 are oriented such that openings 254 of each of the holes are opposing each other. This ensures that an equal force is applied from the top of wrap 244 and the bottom of wrap 244. By applying equal force and equal air flow on both sides of wrap 244, wrap 244 will not distort or swing back and forth from one side to another within chamber 252.

In the embodiment shown in FIG. 5, holes 236 and 238 have a uniform diameter. In one embodiment, openings 254 are approximately 0.015 inches in diameter and are located in a square pattern having five columns of five rows on approximately 4 inch centers. The pair of reservoirs 232 and 234 are approximately 0.050 inches thick, and sufficiently large to ensure that there is substantially no difference in air pressure or air flow through any of the holes 236 and 238. Air reservoirs 232 and 234 are located above and below chamber 252, respectively. Having the same air flow and pressure from each of the openings simplifies the design and construction of the invention.

In the embodiment of FIG. 6, holes 236 and 238 are implemented as bores having two different diameters. The opening 254 remains approximately 0.015 inches in diameter, the diameter of bore 242. A wider diameter bore 240 is employed upstream of opening 242 and downstream from air reservoirs 232 and 234 of FIG. 5. In the embodiment shown in FIG. 6, bore 240 has a diameter of 0.030 inches.

The larger bore 240 diameter serves as a supplemental reservoir to reservoirs 232 and 234 to further ensure that uniform air pressure and air flow are applied through openings 254.

Air flowing through opening 254 will tend to cool the surrounding metal and cause it to contract, altering the air flow. Thus, having holes 236 and 238 of uniform diameter reduces or eliminates problems caused by cooling. Additionally, the speed of operation of the present invention insures that wrap 244 is ejected from opening 224 in approximately 200 milliseconds. This further reduces the effects of thermal changes.

Figure 7:
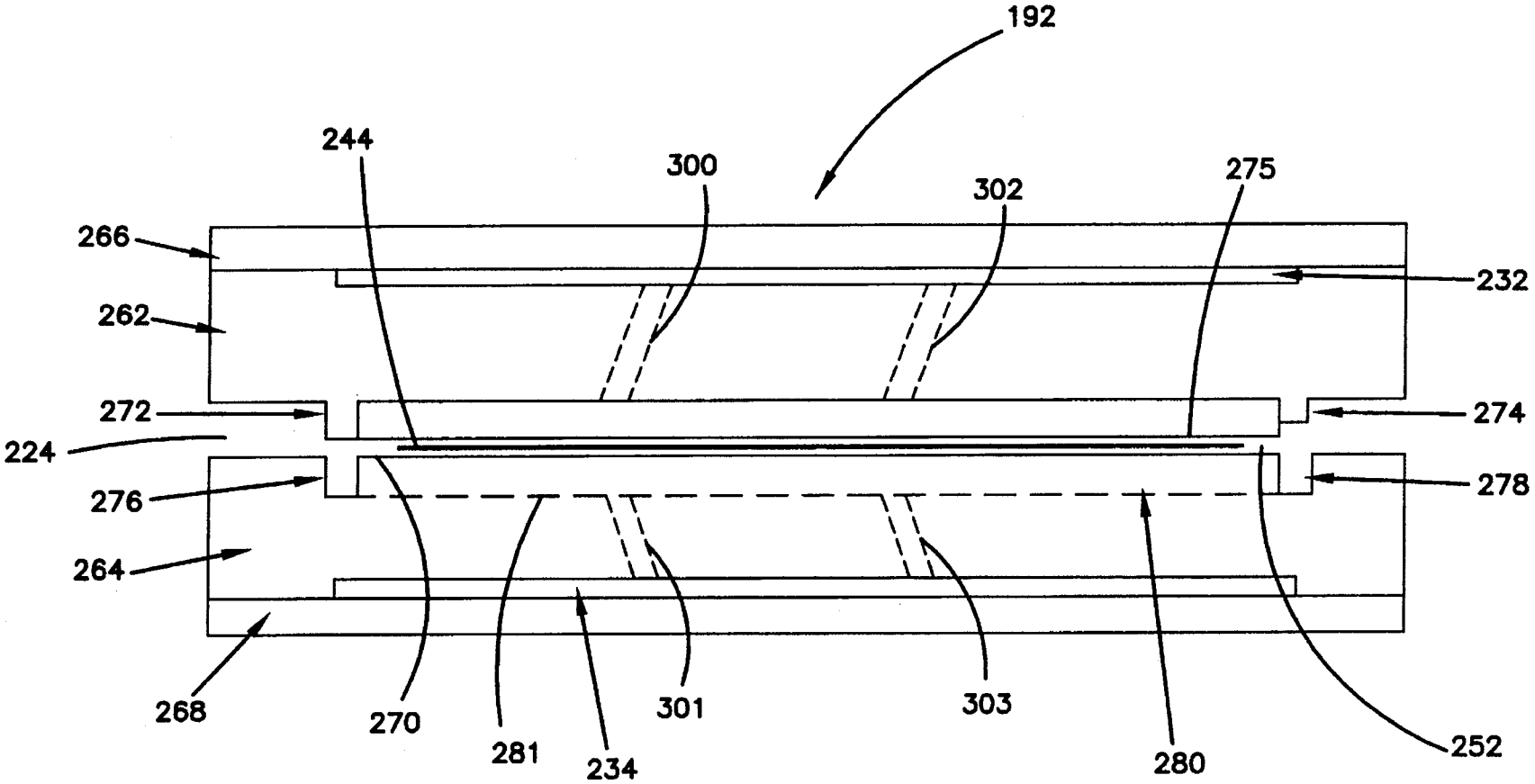
FIG. 7 is an exploded side view of another embodiment of a section of the wrap inserter.

As shown in FIG. 7, in one embodiment of the present invention, chamber 252 is formed by milling away approximately 0.1 inch thick portion of plate 262. Tabs 272, 274, 270 and 275 are left surrounding milled chamber 252. Tabs 270, 275, 272, and 274 are located around all sides of chamber 252. Tabs 272 and 274 extend into chamber 252 adjacent opening 224 and are parallel to the direction of air flow. Tabs 270 and 275 extend into chamber 252 and from tab 272 to tab 274. Tabs 270, 275, 272, and 274 are positioned opposite a series of mating channels 281,280, 276, and 278 respectively, formed by milling out lower plate 264. Tabs 270, 275, 272, and 274, in conjunction with channels 281,280,276, and 278 respectively, provide a predetermined area where wrap 244 is placed prior to insertion into the clamshell 120.

Tabs 270, 275 and 272 are preferably 0.150 inches in height. Tab 274 is approximately 0.060 inches. During operation of the wrap insertion mechanism 192, upper plate 262 is raised above lower plate 264 by a distance of approximately 0.125 inches. This allows wrap 244 to be fed between tab 274 and lower plate 264 into chamber 252.

It is important that tabs 270,275 and 272 have a height nearly equal to the distance upper plate 262 is raised above lower plate 264. This prevents wrap 244 from slipping out of chamber 252 beneath tab 270,275 or tab 272. Tabs 270,275 and 272 may be higher than 0.150 inches, as long as mating channels 281, 280 and 276 respectively, are deep enough to accommodate the higher tabs.

It is important that tab 274 be small enough to allow a wrap to slide between tab 274 and lower plate 264 when the upper plate 262 is in the raised position. It is equally important that tab 274 be large enough so that it is inserted at least partially into mating channel 278 when upper plate 262 is lowered adjacent to lower plate 264. This provides two parallel guides in the form of tabs 272 and 274 for wrap 244 out of inserter 192.

When top plate 262 and bottom plate 264 are moved in position of closest proximity, the height of chamber 252 between upper plate 262 and lower plate 264 is preferably 0.005–0.008 inches greater than the thickness of the wrap to be inserted. This arrangement insures that there is sufficient space within chamber 252 to allow movement of wrap 244 within chamber 252. Yet, the space within chamber 252 is minimized to reduce the volume of air needed to propel wrap 244 through chamber 252 and out opening 224. At the same time, the possibility that wrap 244 will become folded or twisted within chamber 252 is reduced.

When in position within chamber 252, it is preferred that wrap 244 be located approximately 1 to 2 inches away from opening 224. This arrangement allows air to flow out of opening 224 and into envelope 216, of FIG. 5, when air flows through holes 236 and 238 and before wrap 244 is ejected from opening 224. This arrangement further allows edge 218 of clear plastic cover 210 of FIG. 5 to be lowered. Thus, envelope 216 will be filled with air, enlarging clear plastic cover 210 to maximum separation from the body of clamshell 120 of FIG. 5. Hence, wrap 244 can be fully inserted into the clamshell 120.

In one embodiment, it is preferable to design tab 274 so that it can be moved or adjusted closer to, or further away, from tab 272 to allow the insertion of different size wraps 244. It may also be desirable to vary the location or size of chamber 252 by implementing movable tabs 275, 270, 272, and 274 along upper plate 262. This configuration may be desired when a variety of clamshells 120 of FIG. 5 having different dimensions will have wraps 244 inserted by the same wrap inserter 192.

To accommodate the re-configurability, a series of holes may be drilled in upper plate 262 and tabs 270,275, 272, and 274 may be pinned, threaded, or equipped with a threaded bolt to allow the tabs to be selectively positioned. Because of the height of tabs 270, 275, 272, and 274, this configuration is not recommended, as the tabs may become bowed, or otherwise distorted.

As shown in FIGS. 2 and 7, several injection jets 300 and 302 further insure proper seating of the wrap 244 in wrap inserter 192 before wrap 244 is ejected through opening 224. A pair of injection jets 300 and 302 are located in upper plate 262. Similar injection jets 301 and 303 can be located immediately below and opposite to injection jets 300 and 302 in lower plate 264. All injection jets 300, 301, 302 and 303 have openings that are at three-dimensionally compounded angles from tabs 272,270 and 275 respectively. Specifically, injection jets 300 and 302 are approximately 30 degrees from tab 272 and 15 degrees from tabs 275 and 270. Injection jets 301 and 303 are approximately 30 degrees from channel 276 and 15 degrees from tabs 275 and 270. Injection jets 300, 301, 302 and 303 wrap 244 to be positioned against tab 275 and against tab 272 by blowing air through injection jets 300, 301, 302 and 303 and against wrap 244.

The air flow through injection jets 300,301,302 and 303 is isolated from the air flow and air pressure within reservoirs 232 and 234. O-rings can be located between cover plate 266 and upper plate 262, as well as lower cover plate 268 and lower plate 264 to accomplish this. Openings are located in cover plates 266 and 268 to provide air flow to injection jets 300, 301, 302 and 303. It is recognized that alternative methods of providing air flow to injection jets 300, 301, 302 and 303 may be employed, including solid tubes and/or passageways milled in cover plates 266, 268, or upper plate 262 or lower plate 264.

In one embodiment of the present invention, a sensor for detecting wrap 244 can be located between injection jets 300, 301, 302 and 303 and tab 274. Once wrap 244 is detected in this area, air flow to injection jets 300, 301,302 and 303 is initiated. An additional sensor can be located adjacent to tab 272. When wrap 244 is detected adjacent to tab 272, upper plate 262 is lowered toward lower plate 264. Air flow to injection jets 300, 301, 302 and 303 is then discontinued.

An additional sensor may be located adjacent to tab 275 to insure that wrap 244 is properly located against tab 275. The space between tab 272 and channel 276, and tab 274 and channel 280, allows air flow out of chamber 252 enabling wrap 244 to be positioned as desired.

There has been described hereinabove an implementation of a novel packaging system and method. Those skilled in the art may now make numerous uses of the present invention, including variations from the described embodiments without departing from the spirit of the invention which is defined solely by the scope of the following claims.

What is claimed is:

1. A method for inserting a wrap into an envelope formed by a rigid body of a clamshell and a flexible cover of the clamshell comprising the steps of:

positioning the clamshell in a predetermined orientation;

positioning the wrap in a predetermined location substantially coplanar with and adjacent to the opening of the envelope;

suspending the wrap in air;

directing air flow across the wrap and toward the envelope opening;

propelling the wrap while suspended in air into the envelope opening;

opening the clamshell by increasing the distance between the clamshell body and the clamshell cover; and inserting a video cassette into the clamshell.

2. An apparatus for inserting a wrap into an envelope formed by a rigid body of a clamshell and a clear plastic cover of the clamshell, and for inserting a video cassette into a cavity of the clamshell, comprising:

a wrap feeder for transferring a wrap;

a wrap inserter, coupled to the wrap feeder and located adjacent the envelope, for receiving the wrap from the wrap feeder and for inserting the wrap into the envelope;

a video cassette feeder for transferring a video cassette;

a clamshell feeder for transferring the clamshell;

a clamshell dock, coupled to the clamshell feeder and located adjacent to the wrap inserter, for receiving the clamshell from the clamshell feeder and for holding the clamshell stable while a wrap is inserted into the envelope by the wrap inserter; and a video cassette inserter, coupled to the video cassette feeder and intermittently coupled to the clamshell, for receiving the video cassette from the video cassette feeder and for inserting the video cassette into the clamshell substantially contemporaneously with the insertion of the wrap into the envelope.

3. An apparatus for inserting a wrap into an envelope formed by a rigid body of a clamshell, and for inserting a video cassette into a cavity of the clamshell as specified in claim 2, further comprising an envelope enlarger, intermittently coupled to the clamshell while the clamshell is on the clamshell dock, for enlarging the envelope opening before the wrap is inserted into the envelope, wherein the envelope enlarger is a plurality of vacuum driven suction cups.

4. An apparatus for inserting a wrap into an envelope formed by a rigid body of a clamshell in a clear plastic cover of the clamshell, and for inserting a video cassette into a cavity of the clamshell as specified in claim 2, wherein the wrap inserter further comprises a suspension mechanism for suspending the wrap in air, and a propelling mechanism for propelling the wrap into the envelope while being suspended in air by the suspension mechanism.

5. An apparatus for inserting a wrap into an envelope formed by a rigid body of a clamshell in a clear plastic cover of the clamshell, and for inserting a video cassette into a cavity of the clamshell as specified in claim 4, wherein the suspension mechanism further comprises a top plate and a bottom plate, both top plate and bottom plate having a plurality of holes flowing with air while the wrap is inside the wrap inserter, for suspending the wrap in air.

6. An apparatus for inserting a wrap into an envelope formed by a rigid body of a clamshell in a clear plastic cover of the clamshell, and for inserting a video cassette into a cavity of the clamshell as specified in claim 5, wherein the plurality of holes in the top plate and bottom plate of the suspension mechanism are formed at three-dimensionally compounded angles of at least 15 degrees from the plane of the wrap.

7. An apparatus for inserting a wrap into an envelope formed by a rigid body of a clamshell in a clear plastic cover of the clamshell, and for inserting a video cassette into a cavity of the clamshell as specified in claim 2, further comprising an advertising inserter intermittently coupled to the clamshell for inserting an advertisement supplement into the clamshell.

8. An apparatus for inserting a wrap into an envelope formed by a rigid body of a clamshell in a clear plastic cover of the clamshell, and for inserting a video cassette into a cavity of the clamshell as specified in claim 5, wherein the wrap inserter further comprising a plurality of holding tabs, coupled to the top and bottom plates respectively, for holding the wrap within the wrap inserter while the wrap is suspended by the suspension mechanism and before the wrap is inserted into the envelope.

* * * * *